US009835038B2

(12) United States Patent
Paradis et al.

(10) Patent No.: US 9,835,038 B2
(45) Date of Patent: Dec. 5, 2017

(54) INTEGRATED STRUT AND VANE ARRANGEMENTS

(71) Applicant: Pratt & Whitney Canada Corp., Longueuil (CA)

(72) Inventors: Vincent Paradis, Longueuil (CA); John Walter Pietrobon, Outremont (CA); Richard L. Bouchard, Sorel-Tracy (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 780 days.

(21) Appl. No.: 13/961,136

(22) Filed: Aug. 7, 2013

(65) Prior Publication Data

US 2015/0044032 A1 Feb. 12, 2015

(51) Int. Cl.
*F01D 9/04* (2006.01)
*F01D 25/24* (2006.01)

(52) U.S. Cl.
CPC ..... *F01D 9/042* (2013.01); *F01D 25/246* (2013.01)

(58) Field of Classification Search
CPC ..... F01D 9/042; F01D 9/04; F01D 1/02
See application file for complete search history.

(56) References Cited

U.S. PATENT DOCUMENTS 3,604,629 A * 9/1971 Colville ..... F02K 1/72 239/265.31
3,617,147 A 11/1971 Bragg
3,704,075 A 11/1972 Kartensen et al.
3,745,629 A 7/1973 Pask et al.
4,478,551 A 10/1984 Honeycutt, Jr. et al.
4,595,340 A 6/1986 Klassen et al.
4,793,770 A 12/1988 Schonewald et al.
4,989,406 A * 2/1991 Vdoviak ..... F01D 25/162 244/117 A
5,207,556 A 5/1993 Frederick et al.
6,045,325 A 4/2000 Horvath et al.
6,082,966 A 7/2000 Hall et al.
6,331,100 B1 12/2001 Liu et al.
6,331,217 B1 12/2001 Burke et al.
6,439,838 B1 8/2002 Crall et al.
(Continued)

FOREIGN PATENT DOCUMENTS

EP 2206885 7/2010
GB 1058759 2/1967
(Continued)

OTHER PUBLICATIONS

European Search Report, dated Nov. 28, 2014.
(Continued)

*Primary Examiner* — Mark Laurenzi
*Assistant Examiner* — Shafiq Mian
(74) *Attorney, Agent, or Firm* — Norton Rose Fulbright Canada LLP

(57) ABSTRACT

In an integrated strut and turbine vane nozzle (ISV) configuration, lug/slot or tag/groove arrangements may be provided between an interturbine duct (ITD) of the ISV and a vane ring of the ISV such that struts of the ITD and associated vanes are angularly positioned to form integrated strut-vane airfoils, reducing mismatch at the integration.

7 Claims, 11 Drawing Sheets

(56) References Cited

U.S. PATENT DOCUMENTS 6,619,916 B1 * 9/2003 Capozzi ..... F01D 5/148 415/160
6,851,264 B2 2/2005 Kirtley et al.
6,883,303 B1 4/2005 Seda
6,983,608 B2 1/2006 Allen, Jr. et al.
7,055,304 B2 * 6/2006 Courtot ..... F01D 5/146 244/134 B
7,097,420 B2 8/2006 Cormier et al.
7,134,838 B2 11/2006 Dube et al.
7,238,003 B2 * 7/2007 Synnott ..... F01D 11/003 29/889.22
7,322,797 B2 1/2008 Lee et al.
7,544,040 B2 * 6/2009 Marke ..... F01D 9/06 29/889.22
7,549,839 B2 6/2009 Carroll et al.
7,553,129 B2 6/2009 Hoeger et al.
7,753,652 B2 7/2010 Truckenmueller et al.
7,824,152 B2 11/2010 Morrison
7,985,053 B2 7/2011 Schott et al.
8,061,969 B2 11/2011 Durocher et al.
8,091,371 B2 1/2012 Durocher et al.
8,096,746 B2 * 1/2012 Durocher ..... F01D 9/042 415/1
8,099,962 B2 1/2012 Durocher et al.
8,152,451 B2 4/2012 Manteiga
8,177,488 B2 5/2012 Manteiga
8,182,204 B2 5/2012 Durocher et al.
8,192,153 B2 6/2012 Harvey et al.
8,197,196 B2 6/2012 Davis et al.
8,245,518 B2 8/2012 Durocher et al.
8,371,812 B2 2/2013 Manteiga
8,425,185 B2 4/2013 Myoren et al.
8,684,684 B2 4/2014 Clements et al.
8,979,499 B2 3/2015 Allen-Bradley
8,997,494 B2 4/2015 Chuang et al.
9,115,588 B2 8/2015 Nash
9,133,713 B2 9/2015 Allen-Bradley
9,175,693 B2 11/2015 Dutka et al.
9,243,511 B2 1/2016 Lee et al.
9,249,736 B2 2/2016 Carroll
9,284,845 B2 3/2016 Lewis et al.
2006/0018760 A1 1/2006 Bruce et al.
2006/0024158 A1 2/2006 Hoeger et al.
2007/0092372 A1 4/2007 Carroll et al.
2009/0155068 A1 * 6/2009 Durocher ..... F01D 9/042 415/209.2
2009/0155069 A1 * 6/2009 Durocher ..... F01D 9/042 415/209.3
2009/0324400 A1 12/2009 Marini et al.
2010/0080699 A1 * 4/2010 Pietrobon ..... F01D 11/005 415/220
2010/0111690 A1 5/2010 Heriz Agiriano et al.
2010/0132371 A1 * 6/2010 Durocher ..... F01D 9/065 60/796
2010/0132377 A1 6/2010 Durocher et al.
2010/0166543 A1 7/2010 Carroll
2010/0272566 A1 10/2010 Durocher
2010/0275572 A1 * 11/2010 Durocher ..... F01D 9/065 60/39.08
2013/0084166 A1 4/2013 Klingels
2013/0142660 A1 6/2013 McCaffrey
2013/0259672 A1 10/2013 Suciu et al.
2013/0330180 A1 12/2013 Guendogdu et al.
2014/0314549 A1 10/2014 Pakkala et al.
2015/0044032 A1 2/2015 Paradis
2015/0132054 A1 5/2015 Dreischarf
2015/0260103 A1 9/2015 Yu et al.
2016/0281509 A1 9/2016 Pons et al.

FOREIGN PATENT DOCUMENTS

GB 1534124 11/1978
GB 2226600 7/1990

OTHER PUBLICATIONS

Partial European Search Report, dated Apr. 22, 2014.
International Search Report dated Oct. 6, 2016 in PCT application No. PCT/CA2016/050801.
Office Action issued in related U.S. Appl. No. 13/788,474 dated May 16, 2017.

* cited by examiner

INTEGRATED STRUT AND VANE ARRANGEMENTS

TECHNICAL FIELD

The application relates generally to gas turbine engines and, more particularly, to integrated strut and vane arrangements in such engines.

BACKGROUND OF THE ART

Gas turbine engine ducts may have struts in the gas flow path, as well as vanes for guiding a gas flow through the duct. An integrated strut and turbine vane nozzle (ISV) forms a portion of a turbine engine gas path. The ISV usually includes an outer and an inner ring connected together with struts which are airfoil shaped to protect supporting structures and/or service lines in the interturbine duct (ITD) portion, and airfoils/vanes in the turbine vane nozzle portion. The integration is achieved by combining the airfoil shaped strut with the airfoil shape of a corresponding one of the vanes. The ISV can be made from one integral piece or from the assembly of multiple pieces. It is more difficult to adjust the flow of the vane nozzle airfoil if the ISV is a single integral piece. A multiple-piece approach with segments of turbine vane nozzles allows the possibility of mixing different classes of segments in the ISV to achieve proper engine flow. However, a significant challenge in a multiple-piece arrangement of an ISV, is to minimize the interface mismatch between the parts to reduce engine performance losses. Conventionally, complex manufacturing techniques are used to minimize this mismatch between the parts of the integrated strut and vane. In addition, mechanical joints, such as bolts, are conventionally used, but are not preferred because of potential bolt seizing in the hot environment of the ISV.

SUMMARY

In one aspect, there is provided a strut and turbine vane nozzle (ISV) arrangement in a gas turbine engine, comprising: an interturbine duct (ITD) retained with a vane ring, the ITD including inner and outer annular duct walls defining an annular flow passage having an axis, an array of circumferentially spaced-apart struts extending radially across the flow passage, the vane ring including an ray of circumferentially spaced-apart vanes extending between inner and outer rings, each of the struts being angularly aligned in the circumferential direction with an associated one of the vanes, the ITD having at least one first angular positioning element including a first positioning surface and the vane ring having at least one second angular positioning element including a second positioning surface, the first and second positioning surfaces facing each other and both being perpendicular to a tangential direction with respect to the axis, and the first and second positioning surfaces being in contact.

In another aspect, there is provided a strut and turbine vane nozzle (ISV) arrangement in a gas turbine engine comprising: an interturbine duct (ITD) supported within an annular outer casing and coupled at a downstream end thereof with a segmented vane ring which includes a plurality of circumferential segments, the ITD including inner and outer annular duct walls arranged concentrically about an axis and defining a first annular flow passage therebetween, an array of circumferentially spaced-apart struts extending radially across the flow passage, the segmented vane ring including segmented inner and outer rings arranged concentrically about said axis and defining a second annular flow passage therebetween, the second flow passage being positioned downstream of and substantially aligning with the first flow passage, an array of circumferentially spaced-apart vanes extending radially across the second flow passage, each of the struts being angularly aligned with an associated one of the vanes and forming therewith an integrated strut-vane airfoil, each of the segments of the vane ring having said one of the vanes which is in the formation of the integrated strut-vane airfoil, a lug and slot arrangement provided between the ITD and the respective segments of the vane ring to angularly align the struts of the ITD with the respective associated vanes in order to limit mismatch at the integration of the strut-vane airfoils, the ITD and the segments of the vane ring being configured to allow the lug and slot arrangement to be engaged when the ITD and the segmented vane ring are axially moved towards each other during engine assembly.

In a further aspect, there is provided a strut and turbine vane nozzle arrangement in a gas turbine engine comprising: an interturbine duct (ITD) supported within an annular outer casing and coupled to a segmented vane ring which includes a plurality of circumferential segments, the ITD including inner and outer annular duct walls defining an annular first flow passage having an axis, an array of circumferentially spaced-apart struts extending radially across the first flow passage, the segmented vane ring including segmented inner and outer rings arranged concentrically about said axis and defining a second annular flow passage therebetween, the second flow passage being positioned downstream of and substantially aligning with the first flow passage, an array of circumferentially spaced-apart vanes extending radially across the second flow passage, each of the struts being angularly aligned with an associated one of the vanes and forming therewith an integrated strut-vane airfoil, an interface between the strut and the associated vane in each integrated strut-vane airfoil defining a tag-groove configuration wherein the strut at a downstream end thereof includes a first radially extending tag having circumferentially opposed sides and the vane at an upstream end thereof includes a second radially extending tag having circumferentially opposed sides, the first tag and the second tag being forced under aero-dynamic forces during engine operation into contact on one side with the other side free of contact to angularly align the strut and the vane in each integrated strut-vane airfoil.

DESCRIPTION OF THE DRAWINGS

Reference is now made to the accompanying figures in which.

DETAILED DESCRIPTION

Figure 1:
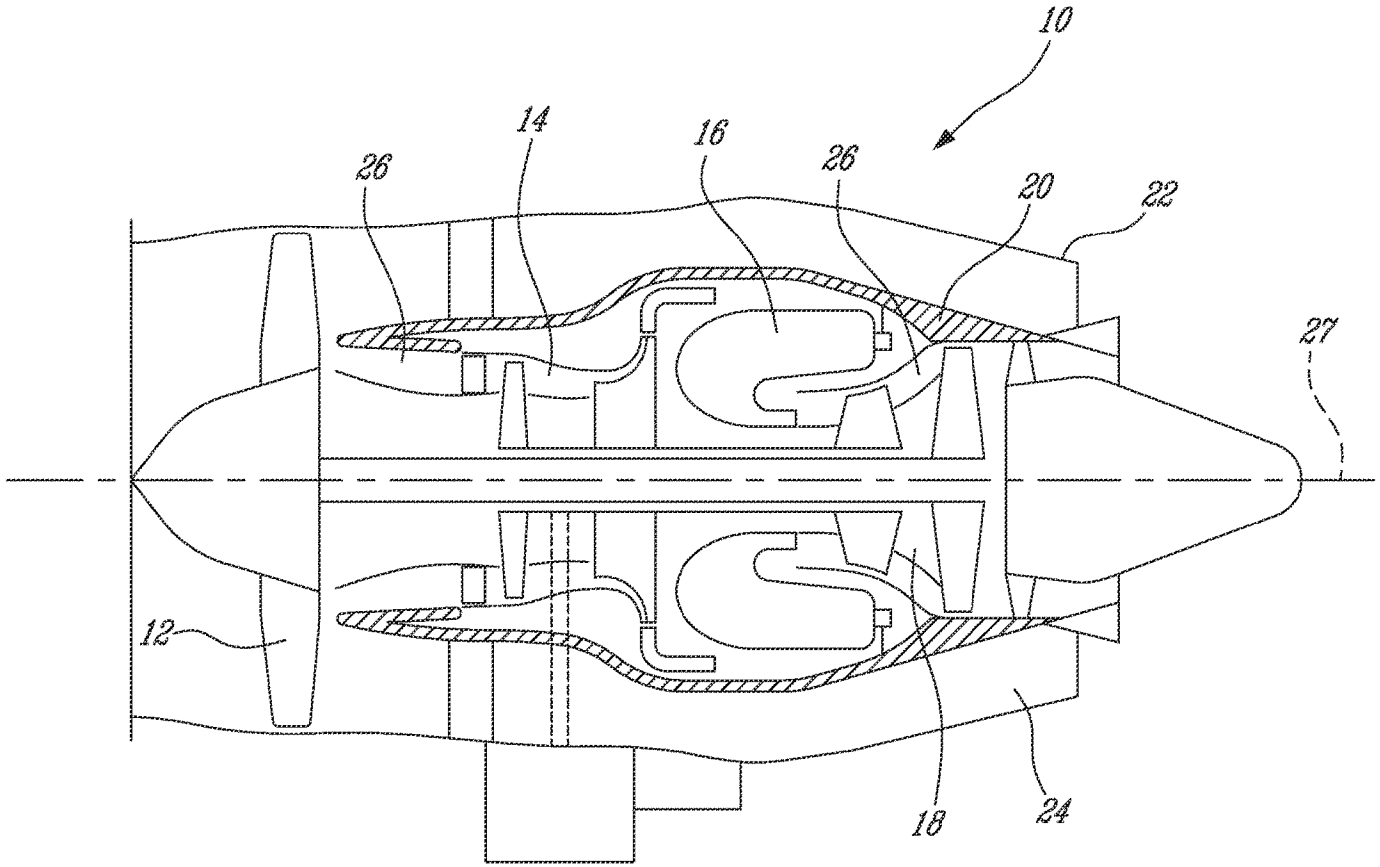
FIG. 1 is a schematic side cross-sectional view of a gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The gas turbine engine 10 includes a first casing 20 which encloses the turbo machinery of the engine, and a second, outer casing 22 extending outwardly of the first casing 20 such as to define an annular bypass passage 24 therebetween. The air propelled by the fan 12 is split into a first portion which flows around the first casing 20 within the bypass passage 24, and a second portion which flows through a core flow path 26 which is defined within the first casing 20 and allows the flow to circulate through the multistage compressor 14, combustor 16 and turbine section 18 as described above.

Throughout this description, the axial, radial and circumferential directions are defined respectively with respect to a central axis 27, and to the radius and circumference of the gas turbine engine 10.

Figure 2:
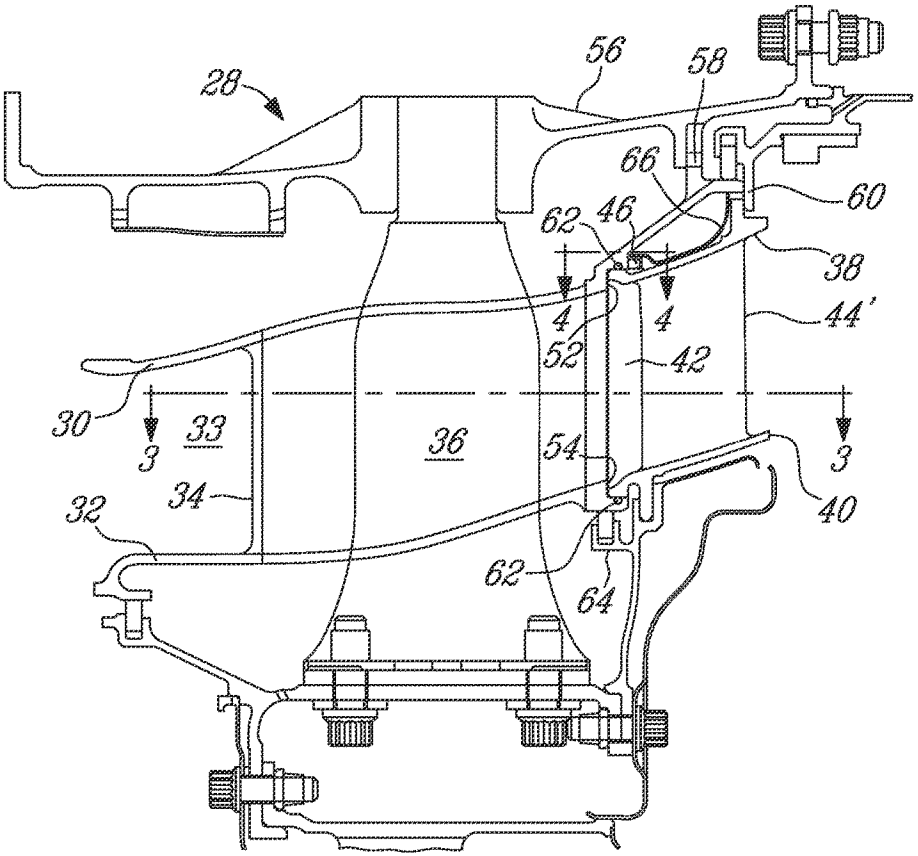
FIG. 2 is a cross-sectional view of an integrated strut and turbine vane nozzle (ISV) suitable for forming a portion of a turbine engine gas path of the engine shown in FIG. 1.

FIG. 2 shows an integrated strut and turbine vane nozzle (ISV) arrangement 28 suitable for forming a portion of the core flow path 26 of the engine 10 shown in FIG. 1. For instance, the ISV arrangement 28 may form part of a mid-turbine frame system for directing a gas flow from a high pressure turbine assembly to a low pressure turbine assembly, however it is understood that the ISV arrangement 28 may be used in other sections of the engine. Also it is understood that the ISV arrangement 28 is not limited to turbofan applications. Indeed, the ISV arrangement 28 may be installed in other types of gas turbine engines, such as turbo props, turbo shafts and axial power units (APU).

The ISV arrangement 28 generally comprises a radially annular outer duct wall 30 and a radially annular inner duct wall 32 concentrically disposed about the engine axis 27 (FIG. 1) and defining an annular flow passage 33 therebetween. The annular flow passage 33 defines an axial portion of the core flow path 26 (FIG. 1).

Figure 3:
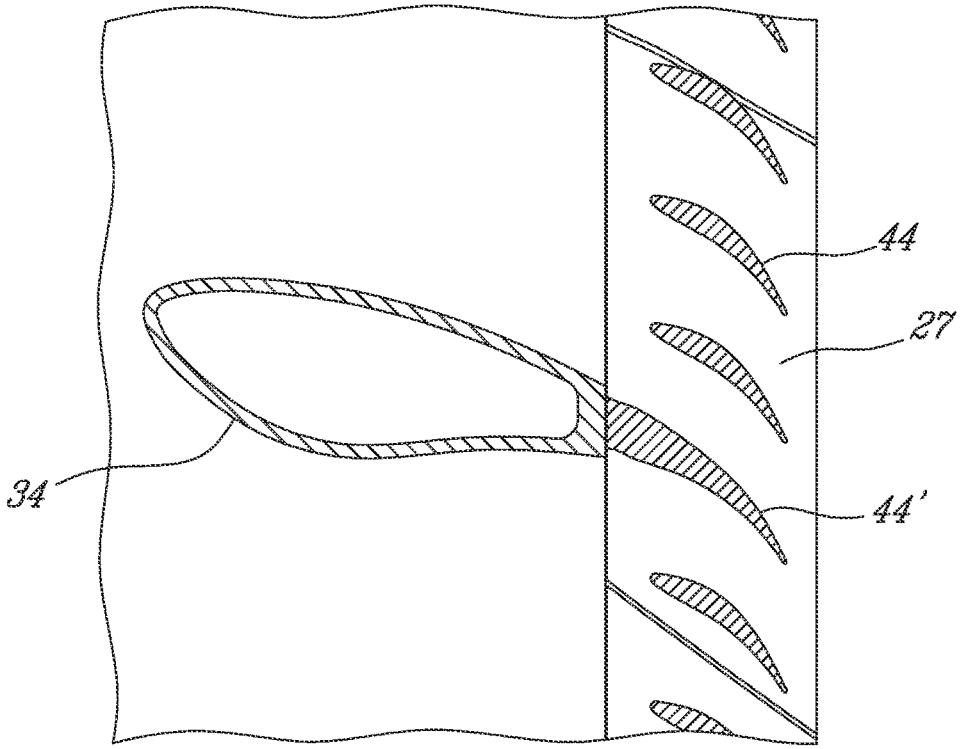
FIG. 3 is a cross-sectional view taken along line 3-3 in FIG. 2.
Figure 4:
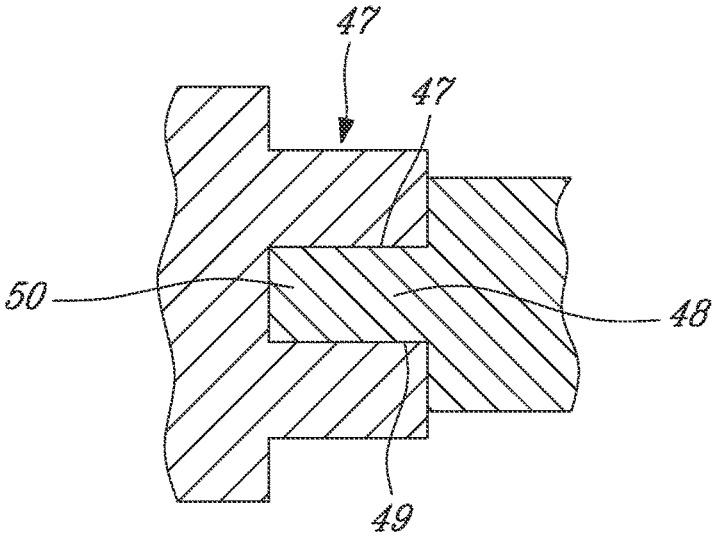
FIG. 4 is a partial cross-sectional view taken along line 4-4 in FIG. 2.

Referring concurrently to FIGS. 2-4, it can be appreciated that a plurality of circumferentially spaced apart struts 34 (only one shown in FIGS. 2 and 3) extend radially between the outer and inner duct walls 30, 32 according to one embodiment. The struts 34 may have a hollow airfoil shape including a pressure side wall and a suction sidewall. Support structures 36 and/or service lines (not shown) may extend internally through the hollow struts 34. The struts 34 may be used to transfer loads and/or protect a given structure (e.g. service lines) from the high temperature gases flowing through the annular flow passage 33. Therefore, the outer and inner duct walls 30, 32 with the struts 34 generally form an interturbine duct (not numbered).

The ISV arrangement 28 further includes a guide vane nozzle section (which is referred to as a vane ring (not numbered) hereinafter). The vane ring may be formed as a single piece part or as a segmented vane ring according to this embodiment. The vane ring may include a radially outer ring 38 and a radially inner ring 40 disposed concentrically about the engine axis 27 and thereby defining an annular flow passage 42 therebetween. The annular flow passage 42 may be positioned downstream, substantially aligning with the annular flow passage 33. An array of circumferentially spaced-apart vanes 44 may extend radially across the annular flow passage 42, each having an airfoil shape with opposed pressure and suction sides for directing the gas flow to an aft rotor (not shown). Each of the struts 34 may be angularly aligned in the circumferentially direction with an associated one of the vanes 44. For convenience of description, the associated one of the vanes is indicated as 44' (see FIG. 3). Each of the struts 34 with associated vane 44' forms an integrated strut-vane airfoil as shown in FIG. 3.

In this embodiment, the segmented vane ring includes a plurality of segments, each segment including a circumferential section of the outer and inner rings 38, 40 and a number of the vanes 44 at least one of which is a vane 44' associated with one of the struts 34. A lug and slot arrangement 46 may be provided between the ITD and respective vane ring segments, in order to limit mismatch at the integration of the strut-vane airfoils. For example, a lug 48 may be attached to the outside of the outer ring 38 of the vane ring, the lug having circumferentially opposed sides 47, 49 (See FIG. 4). The ITD and the vane ring may be configured to allow the lug 48 on each vane ring segment to be axially inserted into a slot 50 defined for example on the outer duct wall 30 at a relatively downstream section of the ITD. Lug 48 may be snuggly received in the slot 50 and therefore the opposed sides 47, 49 of the lug 48 may be in contact with the respective opposed sides of the slot 50, defining the angular positioning surfaces for each of the associated vane 44' with the strut 34 which integrates therewith to form the integrated strut-vane airfoil. It is understood that the ITD includes a number of the slots 50 equal to the number of the lugs 48.

Alternatively, the lug 48 may be loosely received in the slot 50 and may be forced into contact with only one of the opposed sides of the slot 50, by aerodynamic forces during engine operation. One side 47 or 49 of the lug 48 and a corresponding one side of the slot 50 in contact during engine operation, define respective angular positioning surfaces.

In the ISV arrangement 28 according to this embodiment, the ITD may include annular outer and inner shoulders 52 and 54 on the respective outer and inner duct walls 30, 32. Each of the annular shoulders 52, 54 may be axially located in a downstream section of the respective outer and inner duct walls 30, 32. Such downstream sections are defined downstream of the struts 34. For example, the inner annular shoulder 54 may be defined at the downstream end of the inner duct wall 32 and the annular outer shoulder 52 may be defined within the annular outer duct wall 30 axially between a main section of the outer duct wall 30 and a downstream extension which extends axially over and therefore surrounds the outer ring 38 of the vane ring. The annular shoulders 52, 54 are each defined with annular axial and radial surfaces (not numbered). The annular axial surfaces of the outer and inner shoulders 52, 54 face each other to radially position the vane ring when an upstream end of the vane ring is received between the two annular shoulders 52, 54.

An annular groove (not numbered) may be defined in respective axial surfaces of the annular shoulders 52, 54 to receive, for example an annular ceramic rope seal 62 therein in order to reduce gas leakage between the first and second flow passages 32, 42.

The ISV arrangement 28 in this embodiment may further include an outer casing 56 which may be a part of the first casing 20 (shown in FIG. 1), for supporting the ITD and the vane ring. A lug and slot engagement 58 may be provided between the outer casing 56 and the outer duct wall 30, such as an annular lug/flange engaged in an annular slot, for radially and axially retaining the outer duct wall 30 within the outer casing 56 while allowing thermal expansion of the ITD.

The annular slot of the lug and slot engagement 58 may be configured to be disassemble-able in order to allow the annular lug/flange to be axially placed in position. The lug and slot engagement 58 may be located at the downstream extension of the annular outer duct wall 30. The vane ring may be axially restrained between the annular shoulders 52, 54 of the ITD and a low pressure turbine seal structure 60. In operation, the aerodynamic load will push the ITD against the low pressure turbine seal structure 60. The vane segments will be pushed against the low pressure turbine seal 60 and an inner support ring 64.

The inner support ring 64 may be bolted a fixed inner stator structure to supports the vane ring segments during the assembly procedure in order to form the vane ring around the inner support ring 64 such that the vane ring is substantially aligned with the ITD for engine assembly before the upstream end of the vane ring is received between the annular shoulders 52, 54. An annular shield 66 may be provided around the segmented vane ring while the individual segments of the vane ring are placed on the inner support ring 64 to retain the segments during formation of the vane ring on the inner support ring 64, thereby facilitating engine assembly procedures.

Figure 5:
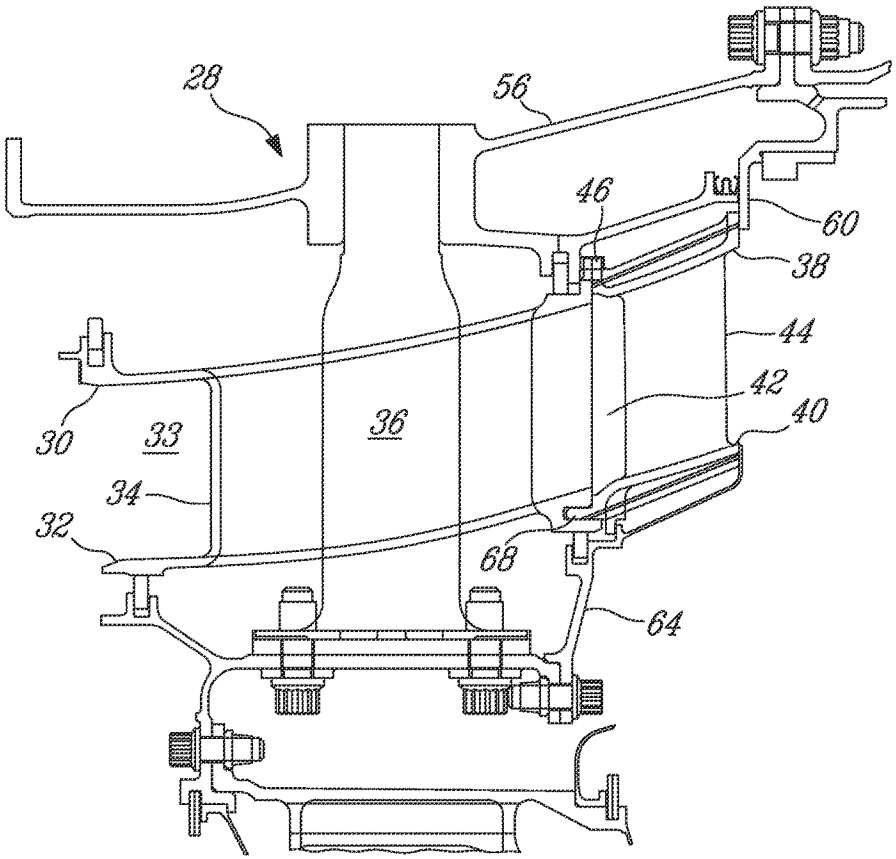
FIG. 5 is a cross-sectional view of an ISV according to another embodiment also suitable for forming a portion of the turbine engine gas path of the engine shown in FIG. 1.
Figure 6:
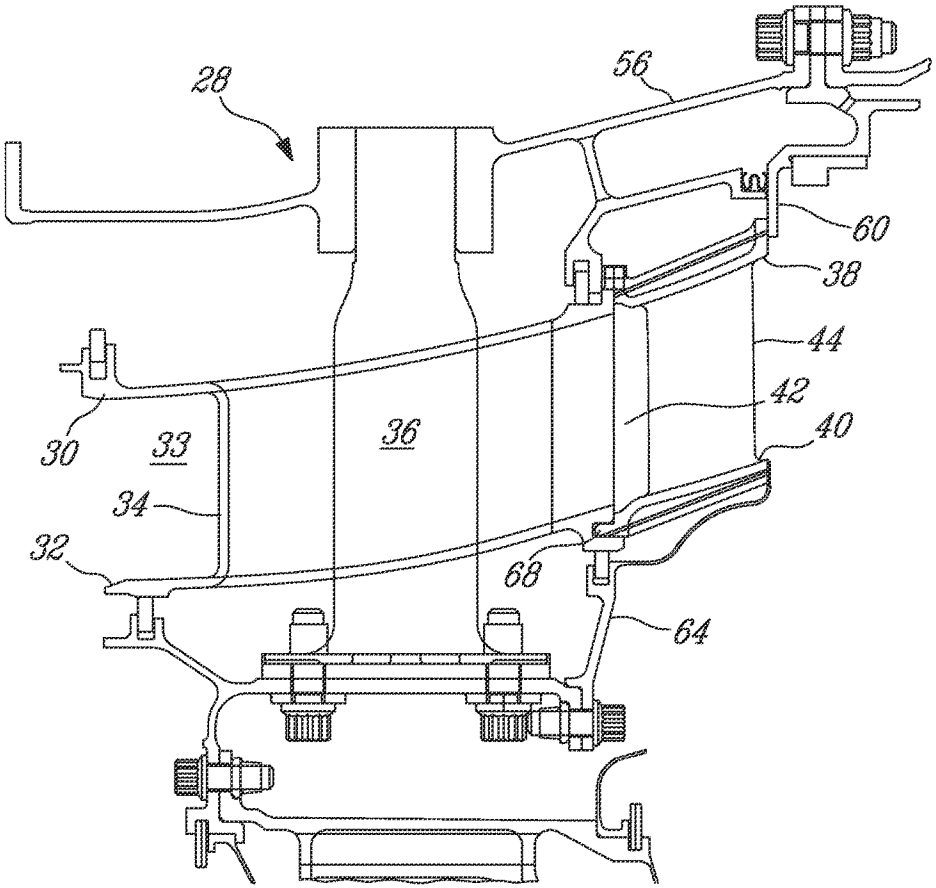
FIG. 6 is a cross-sectional view of an ISV according to a further embodiment also suitable for forming a portion of the turbine engine gas path of the engine shown in FIG. 1.
Figure 7:
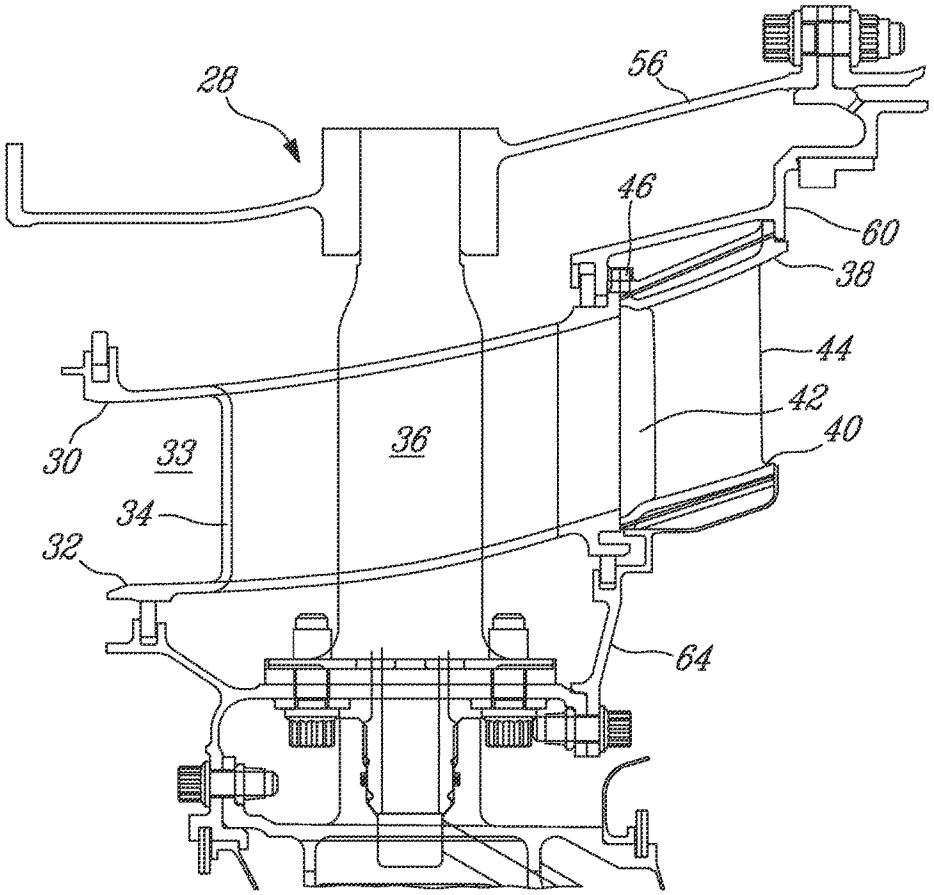
FIG. 7 is a cross-sectional view of an ISV according to a still further embodiment also suitable for forming a portion of the turbine engine gas path of the engine shown in FIG. 1.
Figure 8:
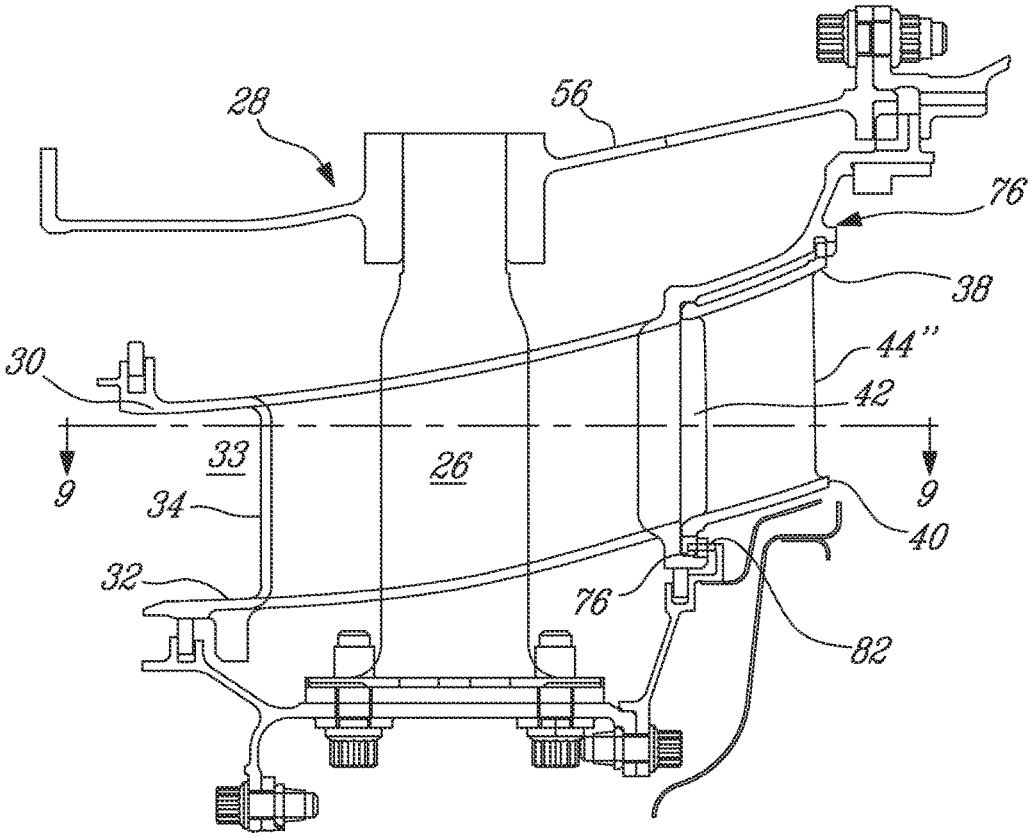
FIG. 8 is a cross-sectional view of an ISV according to a still further embodiment also suitable for forming a portion of the turbine engine gas path of the engine shown in FIG. 1.

FIGS. 5, 6 and 7 show attachment structures between the ITD and the segmented vane ring alternative to the structure shown in FIG. 2, according to further embodiments. Components and features similar to those in FIG. 2 are indicated by like numeral references and will not be redundantly described herein. The annular shoulders 52, 54 shown in FIG. 2 for radially aligning the segmented vane ring with the ITD are replaced by lug and slot arrangements 68 in FIGS. 5 and 6. According to the embodiment of FIG. 5, the radial positioning of the segments is provided by the lug and slot arrangement 68. The ITD is axially shorter and is not reacting against the low pressure turbine seal 60. The axial aerodynamics loads of the ITD are transmitted to the low pressure turbine seal structure 60 through the vane segments. Also, instead of having two separate sets of lugs and slots (one of the ITD at 58 and one for the vane segments at 46) there is only one set of lugs and slots at 46 used for both: ITD radial positioning and for the angular relation of the struts 34 with the corresponding vane airfoil 44'. Both the ITD and the vane segments are trapped axially between the outer casing 56 and the low pressure turbine seal structure 60. The inner support ring 64 has a rear sheet metal portion which is bent upward to provide some axial retention of the vane segments and some sealing of the cavity under the vane segments. A feather seal arrangements between the segments is also shown. This type of sealing arrangement could be removed or added on any configurations if required. With this arrangement, the vane segments are assembled directly in the engine instead of being pre-assembled on the support ring 64. The embodiment of FIG. 6 is similar to the embodiment of FIG. 5 except that the outer casing 56 shape is different. Also, on the support ring 64, only the rear sheet metal portion is providing axial retention. The embodiment of FIG. 7 is also generally similar to the embodiment of FIG. 5. However, the radial positioning of the vane segments is provided by the support ring 64 and the low pressure turbine seal structure 60 (trapped in between) instead of the lug and slot arrangement 68 of FIGS. 5 and 6. The outer casing 56 is simplified and the lug and slot arrangement for the ITD radial positioning and the angular relation of the struts 34 with the corresponding vane airfoil 44' is transferred into the low pressure turbine seal 60. Both the ITD and the vane segments are trapped within the low pressure turbine seal 60.

Regular lugs and slots may be used in the embodiments described above with reference to FIGS. 2-7 in order to allow an axial assembly of the ISV in which the ITD and the segments of the vane ring are assembled by axial movement and are further moved together under aerodynamic forces applied thereon during engine operation.

Referring to FIGS. 8-12, a further embodiment of the ISV arrangement 28 is described. Components and features similar to those in FIG. 2 are indicated by like numeral references and will not be redundantly described herein. Therefore, the description of this embodiment will be focused on the differences between this embodiment and the embodiment shown in FIG. 2. In contrast to the lug and slot arrangement 46 shown in FIG. 2, the angular positioning elements as shown in FIGS. 8-12, are defined at the interface between the respective struts 34 and the associated vane 44" (see FIG. 9) in each integrated strut-vane airfoil. For example, each of the vane ring segments in this embodiment has one of the vanes 44 which is indicated as 44" and together with one strut 34 forms the integrated strut-vane airfoil. The interface between the strut 34 and the associated vane 44" in each integrated strut-vane airfoil, defines a tag-groove configuration wherein the strut 34 includes a radially extending tag 69 having circumferentially opposed sides and the vane 44" includes a radially extending tag 70 having circumferentially opposed sides. During engine operation the tag 69 and tag 70 are forced into contact on one side only under aerodynamic forces, to angularly align the strut 34 and the vane 44" in each integrated strut-vane airfoil. Positioning surfaces 72, 74 on the respective contacting one side of the tags 69, 70 face each other and are both perpendiculars to a tangential direction with respect to the engine axis 27. Surfaces on the other side of the respective tags, 69, 70 each are free of contact and form part of an aerodynamic profile of the integrated strut-vane airfoil.

Figure 9:
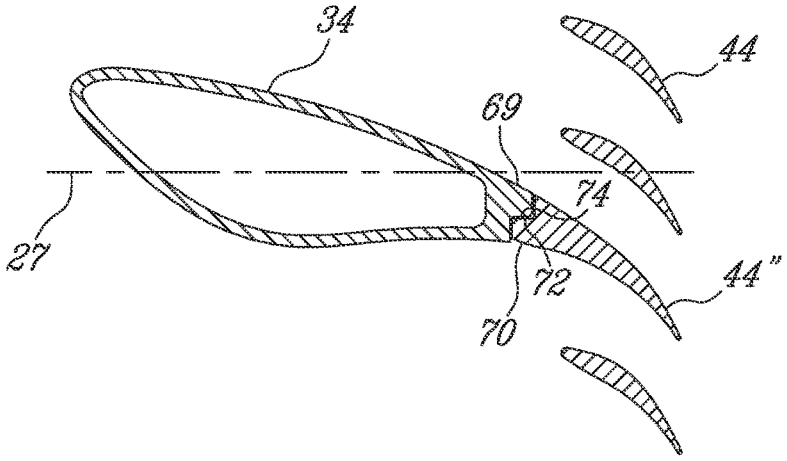
FIG. 9 is a cross-sectional view taken along line 9-9 in FIG. 8.
Figure 10:
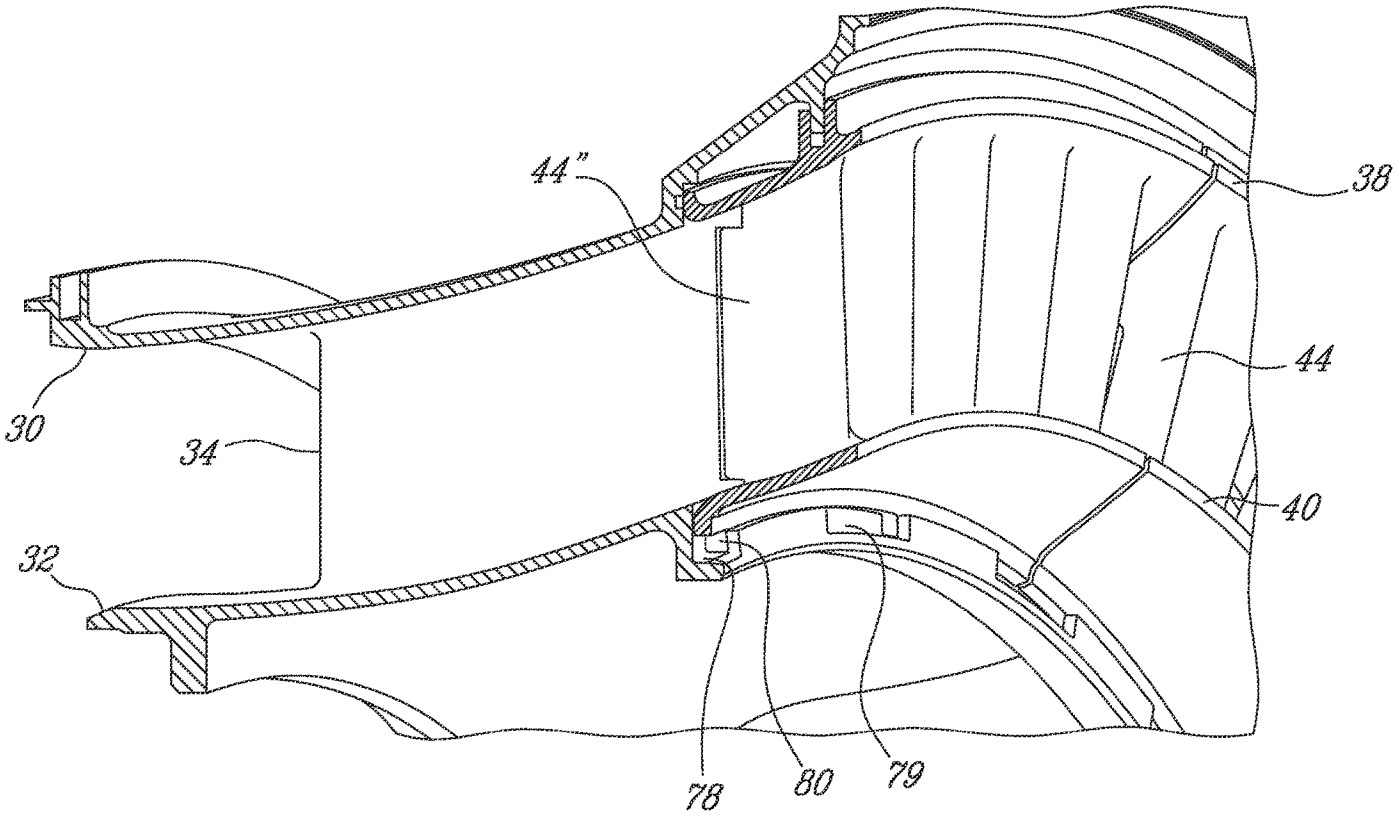
FIG. 10 is a partial isometric view of an interturbine duct (ITD) and the segmented vane ring in the ISV of FIG. 8.
Figure 11:
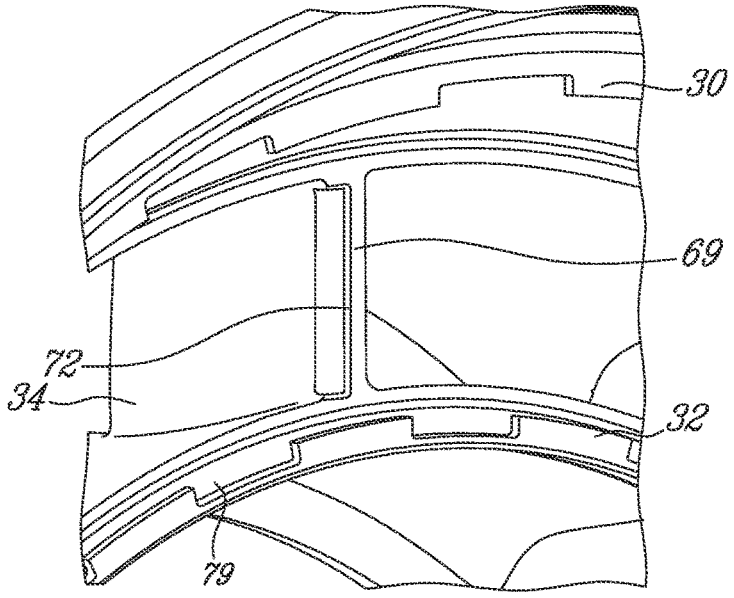
FIG. 11 is a partial isometric view of the ITD of the ISV shown in FIG. 8.
Figure 12:
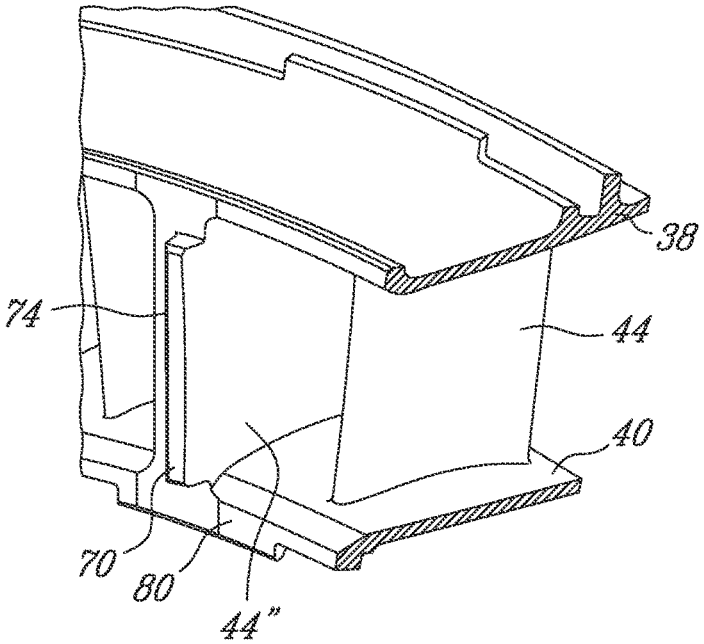
FIG. 12 is a partial isometric view of the vane ring of the ISV shown in FIG. 8.

Tag 69 is axially located at a downstream end of the strut 34 and the downstream end forms an interface between the strut 34 and the associated vane 44" when the strut 34 is integrated with the associate vane 44". The tag 69 extends radially substantially along a radial length of the strut 34 such that the downstream end of the strut 34 defines an axial step in a circumferential cross-section of the strut 34, as shown in FIG. 9.

Tag 70 is axially located at an upstream end of the associated vane 44", and the upstream end forms an interface between the associated vane 44" and the strut 34. The tag 70 extends radially substantially along a radial length of the vane 44" such that the upstream end of the associated vane 44" defines an axial step in a circumferential cross-section of the vane 44" to mate with the axial step formed at the downstream end of the strut 34, as illustrated in FIG. 9.

In the ISV arrangement 28 according to this embodiment, two bayonet mount arrangements 76, one on the inner duct wall and one on the outer duct wall may be provided between the ITD and the respective vane ring segments. The first bayonet mount 76 may include an annular groove 78 defined in a downstream end of the inner duct wall 32 (see FIG. 10). The groove 78 may have axially spaced sides for receiving a number of circumferentially spaced tabs 80 (see FIG. 12) radially inwardly extending from an upstream end of the segmented inner ring 40. The annular groove 78 may have a number of circumferentially spaced apart openings 79 at the rear side thereof, corresponding to and therefore allowing the circumferentially spaced apart tabs 80 to be axially inserted through the respective openings 79 into the groove 78. After the tabs 80 have been received in the annular groove 78, the tabs 80 are slidable within the groove during engine assembly in order to allow the ITD and the segmented vane ring to be circumferentially adjustable until the radially extending tags 69, 70 are in contact with each other. The second bayonet mount on the radially outer duct wall may have a similar construction.

An anti-rotational device 82 (see FIG. 8) may be provided to prevent the segmented vane ring from rotation relative to the ITD when the engine is not in operation and is therefore not generating aerodynamic forces to angularly position the tags 69, 70 of the respective struts 34 and associated vanes 44" against each other. For example the anti-rotation device 82 may be an anti-rotation ring with axial tags (not shown) inserted into the respective openings 79 to prevent the respective tabs 80 from rotating back to the respective openings 79. As mentioned above, a similar bayonet arrangement may also be provided between the outer duct wall 30 of the ITD and the outer ring 38 of the segmented vane ring (see FIGS. 11 and 12).

Figure 15:
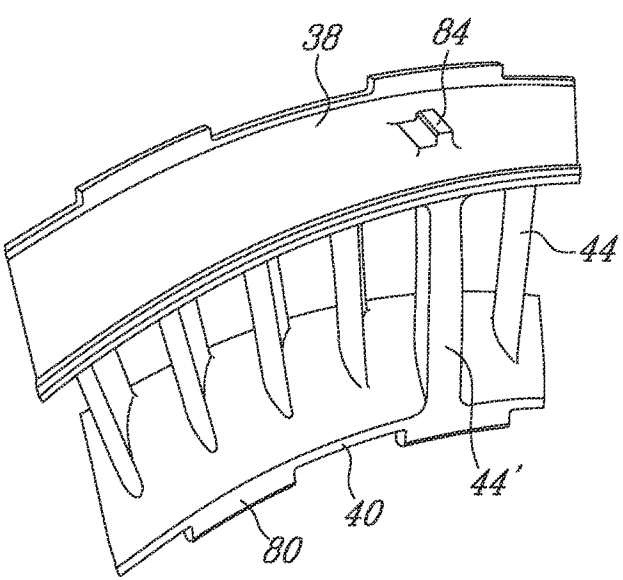
FIG. 15 is an isometric view of a segment of the vane ring in a structure alternative to that shown in FIG. 12.
Figure 14:
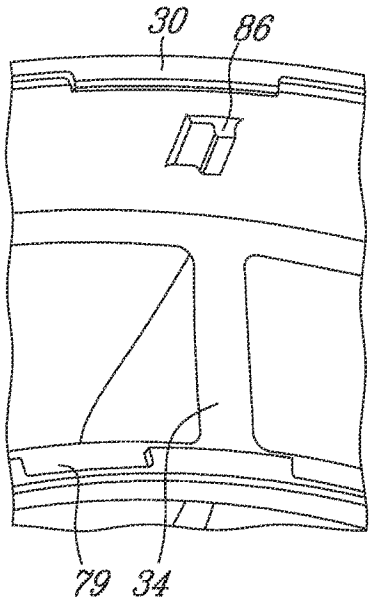
FIG. 14 is a partial isometric view of the ITD of the ISV shown in FIG. 13.
Figure 13:
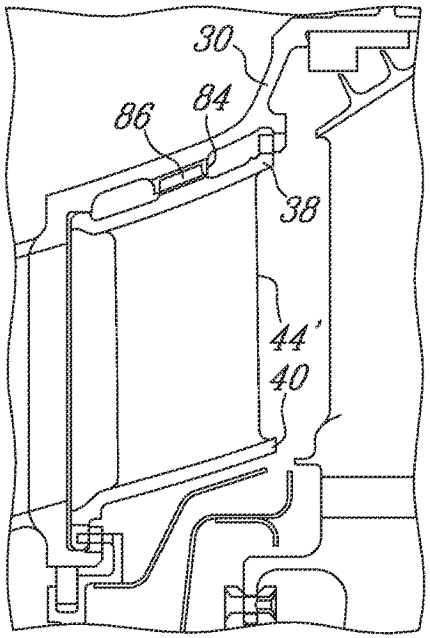
FIG. 13 is a partial cross-sectional view of an ISV according to a still further embodiment alternative to that shown in FIG. 8.

Referring to FIGS. 13-15, a further embodiment of the ISV arrangement 28 is described. Components and features similar to those in FIGS. 2-12 and indicated by like numeral references will not be redundantly described herein. According to this embodiment, two axially extending tags 84, 86 may be provided on the respective outer duct wall 30 of the ITD (axially located at the downstream extension thereof which surrounds the outer ring 38) and on the respective circumferential sections of the segmented outer vane ring. The axial tags 84, 86 in combination form angular positioning elements similar to tags 69, 70 as shown in FIG. 9, thereby defining first and second positioning surfaces to be in contact with each other when the strut 34 is axially aligned with an associated vane 44' of the respective vane segments (similar to that shown in FIG. 3).

Figure 16:
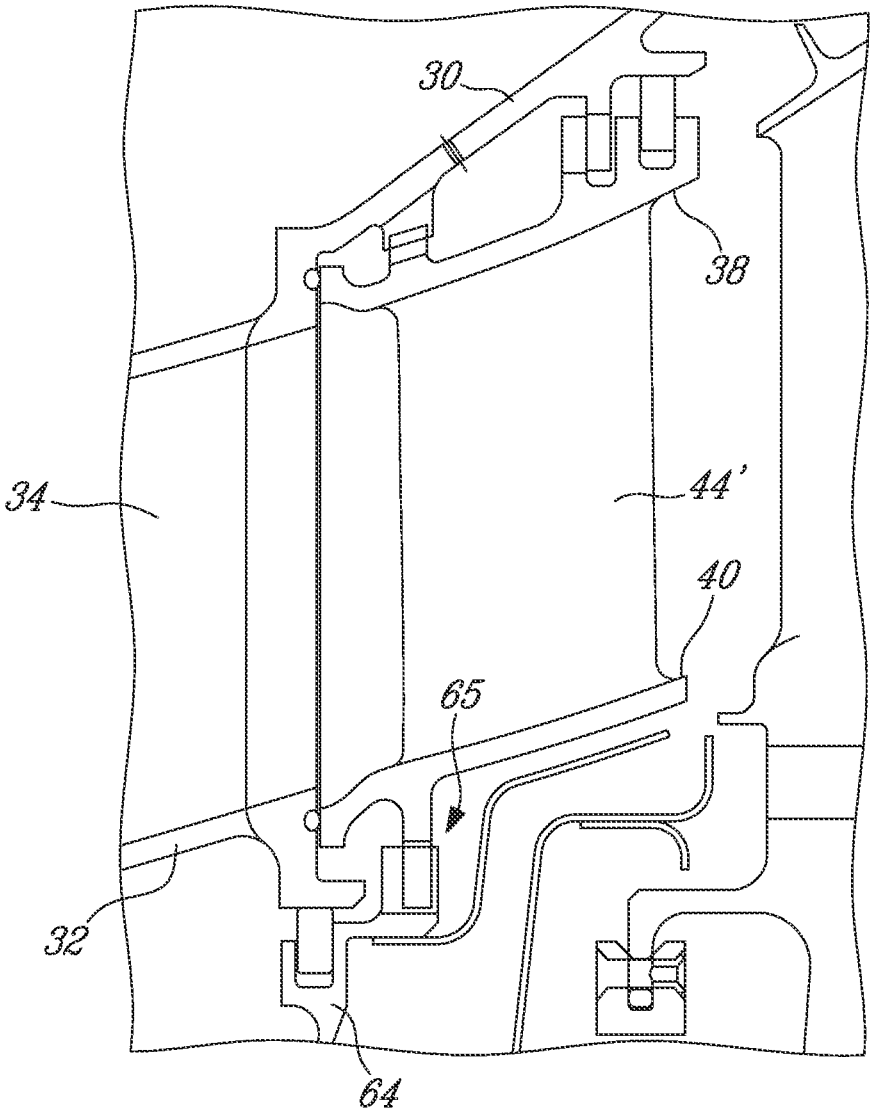
FIG. 16 is a partial cross-sectional view of an ISV including a single piece vane ring.

As shown in FIG. 16, the segmented vane ring may be replaced by a single-piece vane ring using lug and slot arrangements or tag and groove arrangements similar to those described above. At least one or more angular positioning elements may be provided between the ITD and the single piece vane ring in order to reduce mismatch in the respective integrated strut-vane airfoils. For a single piece vane ring, the radial positioning may be provided by a lug and slot arrangement 65 between the vane ring and the inner support ring 64. A bayonet mount may be used on the outer diameter to axially position the vane ring into the ITD.

The above description is meant to be exemplary only, and one skilled in the art will recognize that changes may be made to the embodiments described without departing from the scope of the described subject matter. It is also understood that various combinations of the features described above are contemplated. For instance, the particular angular positioning arrangements described in the various embodiments may be combined with various ITD and vane ring structures in radial or axial retaining systems, which may be new or known to people skilled in the art. Still other modifications which fall within the scope of the described subject matter will be apparent to those skilled in the art, in light of a review of this disclosure, and such modifications are intended to fall within the appended claims.

The invention claimed is:

1. A strut and turbine vane nozzle (ISV) arrangement in a gas turbine engine comprising: an interturbine duct (ITD) supported within an annular outer casing and coupled at a downstream end thereof with a segmented vane ring which includes a plurality of circumferential segments, the ITD including inner and outer annular duct walls arranged concentrically about an axis and defining a first annular flow passage therebetween, an array of circumferentially spaced-apart struts extending radially across the flow passage, the segmented vane ring including segmented inner and outer rings arranged concentrically about said axis and defining a second annular flow passage therebetween, the second annular flow passage being positioned downstream of and aligning with the first annular flow passage, an array of circumferentially spaced-apart vanes extending radially across the second annular flow passage, each of the struts being angularly aligned with an associated one of the vanes and forming therewith an integrated strut-vane airfoil, a lug and slot arrangement provided between the ITD and each of said circumferential segments of the segmented vane ring to angularly align the struts of the ITD with respective said associated one of the vanes, the ITD and said circumferential segments of the vane ring being configured to allow the lug and slot arrangement to be engaged when the ITD and the segmented vane ring are axially moved towards each other during engine assembly, the lug and slot arrangement comprising a plurality of lugs projecting from the segmented outer ring of the segmented vane ring and a plurality of slots defined in a rear end of the outer annular duct wall of the ITD, the plurality of lugs being axially insertable in the plurality of slots, the plurality of lugs and the plurality of slots having circumferentially opposed surfaces abutting one against the other in a circumferential direction relative to the ITD and the segmented vane ring.

2. The strut and turbine vane nozzle (ISV) arrangement as defined in claim 1 wherein the ITD comprises an annular shoulder on each of the inner and outer duct walls, each of the annular shoulders being axially located downstream of the struts and defined with annular axial and radial surfaces, the annular axial surfaces on the respective inner and outer annular duct walls radially facing each other to radially position the segmented vane ring when an upstream end of the segmented vane ring is received between the two annular shoulders.

3. The strut and turbine vane nozzle (ISV) arrangement as defined in claim 2, wherein the segmented vane ring is axially restrained between the annular shoulders of the ITD and a low pressure turbine seal.

4. The strut and turbine vane nozzle (ISV) arrangement as defined in claim 2, wherein the annular axial surface of the respective first and second annular shoulders comprises an annular groove receiving therein a ceramic rope seal.

5. The strut and turbine vane nozzle (ISV) arrangement as defined in claim 1, wherein a lug and slot engagement is provided between the annular outer casing and the ITD for radially and axially retaining the ITD within the annular outer casing while allowing thermal expansion of the ITD.

6. The strut and turbine vane nozzle (ISV) arrangement as defined in claim 5, wherein the lug and slot engagement between the annular outer casing and the ITD are axially located at a downstream section of the ITD.

7. The strut and turbine vane nozzle (ISV) arrangement as defined in claim 1 further comprising a support ring for supporting the circumferential segments forming the segmented vane ring around the support ring such that the segmented vane ring is aligned with the ITD for engine assembly, an annular shield being placed around the segmented vane ring to retain the segments during assembly of the segmented vane ring on the support ring.

* * * * *